United States Patent [19]

Valdatta

[11] 4,091,876

[45] May 30, 1978

[54] FIRE SPRINKLING SYSTEM FOR MOBILE TRAILERS

[76] Inventor: Robert P. P. Valdatta, 208 4th Ave., Seward, Ak. 99664

[21] Appl. No.: 704,682

[22] Filed: Jul. 12, 1976

[51] Int. Cl.[2] ..... A62C 35/12

[52] U.S. Cl. ..... 169/62; 169/11; 169/16

[58] Field of Search ..... 169/62, 64, 11, 13, 169/14, 16

[56] References Cited

U.S. PATENT DOCUMENTS

| | | | |
|---|---|---|---|
| 1,599,411 | 9/1926 | Gilsenan | 169/16 X |
| 1,620,142 | 3/1927 | Thompson | 169/16 X |
| 1,831,880 | 11/1931 | Pierce | 169/16 |
| 3,688,846 | 9/1972 | Lease | 169/16 |
| 3,892,277 | 7/1975 | Curran | 169/16 |
| 3,993,139 | 11/1976 | Vaughn | 169/62 |

FOREIGN PATENT DOCUMENTS

| | | | |
|---|---|---|---|
| 8,095 | 7/1927 | Austria | 169/54 |

*Primary Examiner*—John J. Love
*Attorney, Agent, or Firm*—Marden S. Gordon

[57] ABSTRACT

A unique fire protection system for the exterior, although adaptable to the interior, of mobile trailers, such as campers, mobile homes, cargo trailers, and the like, consisting of a loop of tubing mounted around the perimeter of a mobile trailer roof top with a series of spray nozzles affixed therealong to spray a fire extinguishing solution, such as water, carbon dioxide, a mixture of both, or the like, over the top of the trailer roof and downwardly on all four sides of a trailer. Two feed lines are provided into the fire sprinkling system, the input end of one feed line being provided with a water hose connector and shut-off valve and the input end of the other feed line being directly attached to a pressurized carbon dioxide tank also provided with a shutoff valve, and with each feed line being provided with a check valve to permit flow of water or carbon dioxide into the fire extinguishing system and so as to prevent backflow of the water or carbon dioxide.

1 Claim, 6 Drawing Figures

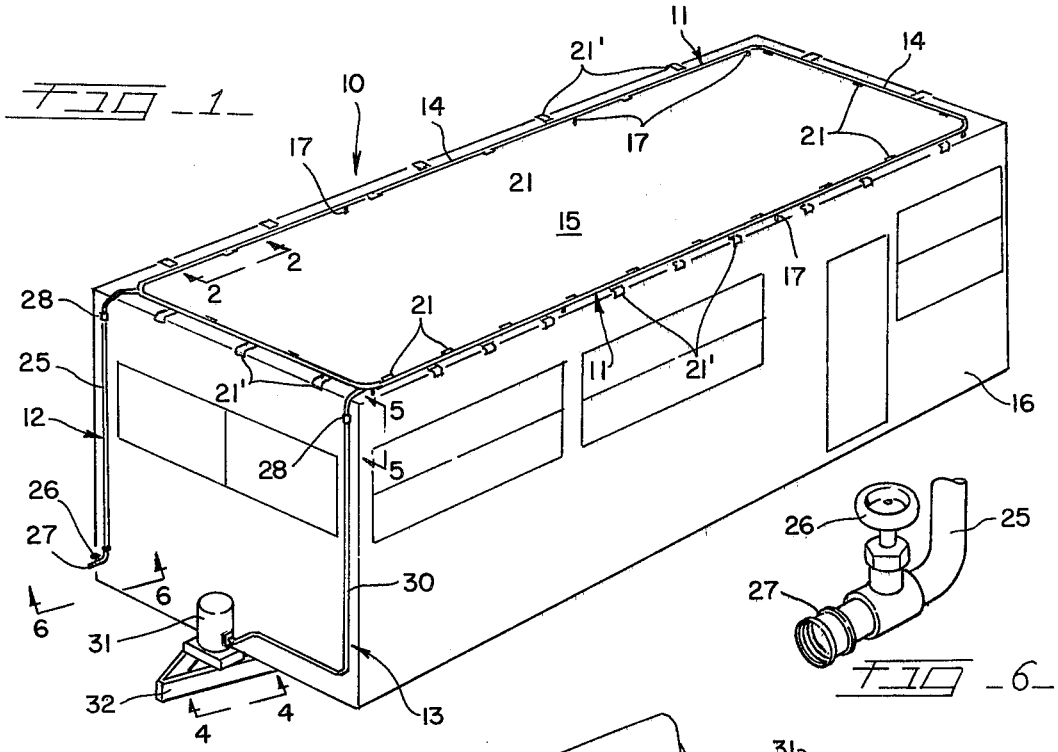
FIG. 1
FIG. 6
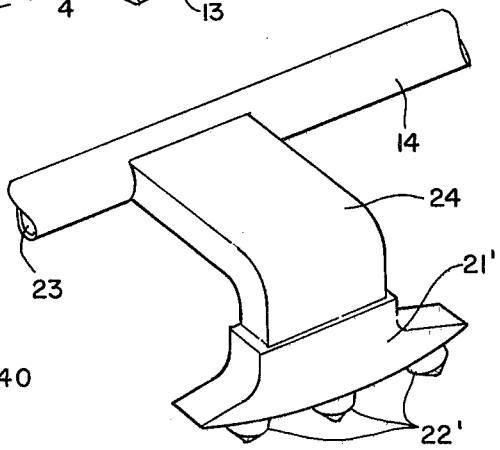
FIG. 3
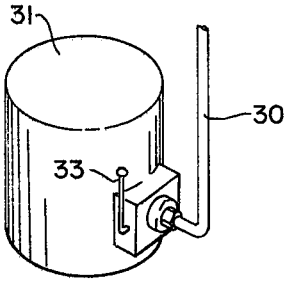
FIG. 4
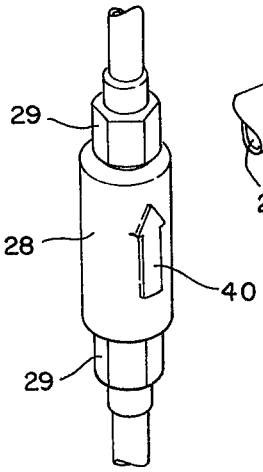
FIG. 5
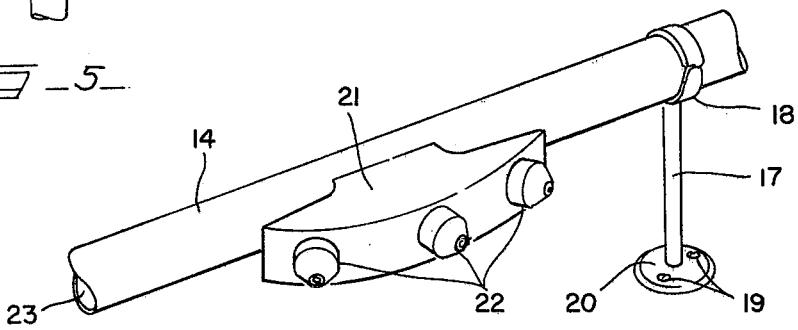
FIG. 2

FIRE SPRINKLING SYSTEM FOR MOBILE TRAILERS

BACKGROUND OF THE INVENTION

1. Field of the Invention

This invention relates to a fire sprinkling system for the exterior, although adaptable to the interior, of mobile trailers, such as campers, mobile homes, cargo trailers, and the like, wherein a fire extinguishing solution, such as water, carbon dioxide, a mixture of both, or the like, is sprayed under pressure over the roof top and along the sides of the mobile trailer in case of fire or of danger of fire thereto.

2. Description of the Prior Art

A great number of deaths or injuries are caused regularly by fires in mobile trailers, fires often being caused by collisions on the highways or by other careless acts or accidents. Conventional techniques for extinguishing fires would, of course, include calling a fire department, spraying water on a trailer from a garden type hose, pouring buckets of water on the fire, the use of a portable fire extinguishing unit, or the like. Fire extinguishing systems have been described for use on vehicular trailers, but they are generally restricted to a specific applications or are complex and costly to manufacture. For example, U.S. Pat. No. 3,738,428 issued to Ingro June 12, 1973 describes a safety fuel tank to prevent fire or explosion in fuel transporting tank trucks consisting of a pressurized jacket completely encompassing the fuel carrying tank. U.S. Pat. No. 3,884,308 issued to Green May 20, 1975 describes a fire extinguisher mechanism for a trailer consisting of a series of flat enclosed tanks mounted above the ceiling of a trailer with a plurality of sprinkler heads extending downwardly from the tanks through the ceiling having a low melting point solder which is melted by heat to cause the sprinkler heads to operate. Pat. 3,762,479 issued to Fike, Sr. et al. Oct. 2, 1973 describes a remotely actuatable portable fire supression apparatus for use in relatively confined areas such as engine compartments and restaurant ventilation hoods and the like. U.S. Pat. No. 3,788,666 issued to Kramer et al. Jan. 29, 1974 covers a protection system for protecting people and property carried by a vehicle, such as an automobile or air craft, including a tank filled with a fire extinguishing agent and an inflatable bag which becomes inflated immediately upon impact with another vehicle. There is, then, an obvious need for a fire sprinkling system permanently mounted to the roof of the mobile trailer and which can be easily operated by an individual when the need arises.

SUMMARY OF THE INVENTION

The present invention provides a fire sprinkling system for mobile trailers for readily spraying a fire extinguishing solution, such as water, carbon dioxide, or a mixture of both, or the like, over the roof top and sides of a mobile trailer, with the fire extinguishing system being adaptable to the interior of a mobile trailer or for other uses.

It is a feature of the present invention to provide a fire sprinkling system for mobile trailers.

A further feature of the present invention provides a fire sprinkling system for mobile trailers which is easy to use and reliable and efficient in operation.

Yet still a further feature of the present invention provides a fire sprinkling system which is of a rugged and durable construction and which, therefore, may be guaranteed by the manufacturer to withstand long and continual usage.

An additional feature of the present invention provides a fire sprinkling system which is simple in construction and which, therefore, may be produced by a manufacturer at an economical cost.

Other features of this invention will be apparent during the course of the following description.

BRIEF DESCRIPTION OF THE DRAWINGS

In the accompanying drawings forming a part of this specification, and in which like reference characters are employed to designate like parts throughout the same:

FIG. 1 is a perspective view of the fire sprinkling system for mobile trailers shown mounted to a trailer roof top; and FIG. 2 is a perspective view of a spray nozzle as used for the roof top of a mobile trailer; and FIG. 3 is a perspective view of a spray nozzle as used for the sides of a mobile trailer; and FIG. 4 is a perspective view of a pressurized carbon dioxide tank attached to the input of one feed line; and FIG. 5 is a perspective view of the check valve; and FIG. 6 is a perspective view of a water hose connection and valve attached to the input end of one feed line.

DESCRIPTION OF THE PREFERRED EMBODIMENT

Referring now to the drawings in detail, there is illustrated a preferred form of the fire sprinkling system for mobile trailers constructed in accordance with the principles of the present invention and which is designated generally in its entirety by the reference numeral 10 and which is comprised of a sprinkler loop 11, a water feed line 12, a carbon dioxide feed line 13, and associated hardware and interconnecting components as will be later described.

The sprinkler loop 11 is constructed of cylindrical tubing 14, as typically used in fire sprinkling systems, and is formed into a rectangular or other geometric configuration as required to span the perimeter on top of a roof 15 of a trailer 16. The cylindrical tubing 14 is mounted to the roof 15 by means of a series of stand-off brackets 17 which, as shown in FIG. 2, are securely affixed around the outside diameter of the cylindrical tubing 14 by means of a ring 18 and are mounted to the roof 15 by means of the screws 19 through the base 20 of the stand-off brackets 17, the stand-off brackets 17 thereby maintaining the cylindrical tubing 14 to be securely affixed a short distance upwardly around the perimeter of the roof 15. A series of sprinkler heads 21, to each of which is affixed a series of nozzles 22, are spaced approximately one foot apart along the inside perimeter of the cylindrical tubing 14 so that the nozzles 22 are aimed over the roof 15, with all the connections between the sprinkler heads 21 and the cylindrical tubing 14 being water tight, such as provided by welding, and with the connections between the sprinkler heads 21 and nozzles 22 being water tight, such as by welding, threaded connections, or the like, and with the cylindrical tubing 14 being further provided with a series of openings (not shown) for attachment of the sprinkler heads 21 thereto in order to provide free access between the hollow interior 23 and the interior of the sprinkler heads 21. A series of sprinkler heads 21', to which a series of nozzles 22' are attached in the same way as the nozzles 22 are attached to the sprinkler heads 21, are connected by means of a series of L-shaped couplers 24 around the outside perimeter of the cylindrical tubing 14 with spacing appoximately one foot apart so that the nozzles 22' extend outwardly and downwardly from the cylindrical tubing 14 so as to be aimed around the sides of the trailer 16, with all connections being water tight as previously described concerning the sprinkler heads 21.

The water feed line 12 consists of a length of tubing 25, which is similar in construction to the cylindrical tubing 14, and, as shown in FIG. 1, runs vertically along one side of the trailer 16 and is connected in a conventional manner on the roof 15 to the cylindrical tubing 14 and is connected on its bottom end in a conventional manner to a shut-off valve 26 and a water hose bib 27. A check valve 28 is interconnected along the length of the tubing 25 in a conventional way, such as by means of the nuts 29, so as to restrict the flow of water through the tubing 25 in a single direction as shown by the arrow 40 so as to prevent back flow of water from the cylindrical tubing 14 into the tubing 25 when a water hose is attached to the bib 27 and water is being forced through the sprinkler loop 11.

The carbon dioxide feed line 13 is similar in construction to the water feed line 12 and consists of a length of tubing 30 which, as shown in FIG. 1, is formed in a vertical plane along one side of the trailer 16 is connected on its top end to the cylindrical tubing 14 and on its bottom end to a carbon dioxide reservoir tank 31 which is mounted in a conventional way to the trailer hitch 32 or to the side of the trailer 16, with the carbon dioxide tank 31 being provided with an on-off lever 33. A check valve 28 is similarly interconnected along the length of tubing 33 and serves the same function as described in relation to the water feed line 12.

In operation, when the trailer 16 catches fire or danger exists from the nearby fire, an individual could immediately turn the on-off lever 33 to an on position to force the pressurized contents of the carbon dioxide tank 31 through the carbon dioxide feed line 13 into the sprinkler loop 11 so as to force carbon dioxide through the sprinkler heads 21 and 21' and the nozzles 22 and 22' in order to forcably spray a fire extinguishing agent over the roof 15 and simultaneously over the sides of the trailer 16 to extinguish any fire thereon or to prevent fire from spreading to the trailer 16 around the nearby area. If a water hose is available, a water hose can be quickly connected to the bib 27, a shut-off valve 26 can then be turned on to force water through the water feed line 12 to the sprinkler loop 11 to force water over the roof 15 and around the sides of the trailer 16 similarly to the procedure described above for carbon dioxide. Either water, carbon dioxide, or both fire extinguishing agents can simultaneously be forced through the sprinkler loop 11. The check valves 28 provided in the water feed line 12 and the carbon dioxide feed line 13 force respective agents in one direction through the sprinkler loop 11 and prevent back flow of water or carbon dioxide into the respective feed lines. When the fire is extinguished or the danger of fire has passed, the fire sprinkling system 10 can be shut off by reversing the above described procedure.

There is thus described a novel fire extinguishing system for mobile trailers which meets all of its stated objectives and which overcomes the disadvantages of existing less efficient and cumbersome techniques.

It is to be understood that the form of this invention as shown and described is to be taken as a preferred example thereof, and that this invention is not to be limited to the exact arrangement of parts described in the description or illustrated in the drawings as changes thereto in the details thereof pertaining to size, shape and arrangement of parts thereof are envisioned within the scope of the invention without departing from the novel concepts of the invention. For example, the fire sprinkling system could be installed on the ceiling within the interior of a mobile home or it could be installed on the roof top with sprinkler heads and nozzles projected through the roof top to the interior of a mobile trailer.

Having thus described the invention what is claimed is:

1. A fire sprinkling system for a mobile trailer having a roof and sidewalls extending downwardly from the perimeter edges of the roof, the system comprising, in combination:

a plurality of stand-off brackets each having one end mounted to the roof at a position spaced inwardly of the edge perimeters, with the brackets projecting upwardly from the roof and terminating in a ring-shaped holder a short distance above the roof, the brackets being disposed on the roof in spaced apart series relationship defining generally a configuration concentric with the roof perimeter edges and spaced slightly inwardly therefrom;

an endless sprinkler loop of cylindrically shaped tubing disposed above the roof and secured in position thereabove by passing through the ring-shaped holders on the stand-off brackets, the loop thus being concentric with the perimeter of the roof edges and passing completely thereabout;

a series of sprinkler heads disposed about the loop and facing inwardly from the loop generally parallel to the roof, the sprinkler heads spaced from the roof, each of the sprinkler heads being in fluid communication with the loop tubing and mounted thereon to receive therefrom any substance flowing through the tubing, each sprinkler head having a face surface spaced furthest from the tubing;

a series of L-shaped hollow couplers disposed about the loop in spaced relationship to each other, each coupler having one end in fluid communication with the tubing with the couplers extending outwardly from the tubing in a direction to project over the adjacentmost roof perimeter edge with their opposite end disposed generally parallel to the trailer sidewalls and opening downwardly from the roof;

a plurality of sprinkler heads, each head associated with one of the couplers and affixed thereto in fluid communication therewith, each head having a face surface spaced furthest from the coupler;

a plurality of nozzles mounted to the face surface of the first mentioned sprinkler heads in fluid communication therewith for directing a flow of any substance through the loop and sprinkler heads onto the roof, each of the nozzles being independent of each other and directed in a manner to completely cover the roof with their spray;

a plurality of nozzles mounted to each of the face surfaces of each of the second mentioned sprinkler heads in fluid communication therewith for directing a flow of any substance through the loop and couplers and sprinkler heads onto the surfaces of the sidewalls, each of the nozzles being independent of each other and directed in a manner to completely cover the sidewalls with their spray;

a tubular water feed line having one end connected to the sprinkler loop in fluid communication therewith, the water feed line running downwardly therefrom and terminating at is opposite end adjacentmost a lower portion of a sidewall forming the front of the trailer;

a water shut-off valve operable between an open and closed position connected to the terminal end of the water feed line for controlling the flow of water therethrough;

a hose bib connected to the free end of the water shut off valve adapted to have a water hose connected thereto for supplying a source of water thereto;

a one-way check valve connected in the water feed line intermediate the shut-off valve and the sprinkler loop, the check valve permitting flow of water in the direction to feed the sprinkler loop while preventing any flow of any substance backward from the sprinkler loop into the water feed line;

a carbon dioxide feed line of a tubular configuration having one end in fluid communication with the sprinkler loop and with its opposite end extending downwardly from the loop along a sidewall of the trailer and terminating at a position adjacentmost a lower portion of a sidewall defining the front surface of the trailer;

a carbon dioxide reservoir tank containing a rechargable supply of pressurized carbon dioxide, the tank mounted on a sidewall of the trailer and connected in fluid communication with the free end of the carbon dioxide feed line;

a carbon dioxide shut-off control valve operable between an open and closed position, the valve disposed adjacent the tank in the feed line for controlling the flow of carbon dioxide from the tank into the feed line;

a one-way check valve connected in the carbon dioxide feed line intermediate the control valve and the sprinkler loop, the check valve restricting all flow through the feed line to be in the direction to feed the sprinkler loop while preventing any backflow of any substance from the sprinkler loop into the carbon dioxide feed line;

whereby water can be directed into the system with the check valve in the carbon dioxide feed line preventing loss of water from the system therethrough, or carbon dioxide can be directed into the system with the check valve in the water feed line preventing loss of carbon dioxide from the system therethrough, or wherein a combination of both water and carbon dioxide can be simultaneously directed into the system for discharge through the nozzles.

* * * * *